US005755651A

United States Patent [19]

Homyonfer et al.

[11] Patent Number: 5,755,651

[45] Date of Patent: May 26, 1998

[54] EXERCISING DEVICE

[76] Inventors: David Homyonfer; Danny Homyonfer, both of 27 Dubonov Street, Holon 58804, Israel

[21] Appl. No.: 698,562

[22] Filed: Aug. 15, 1996

[30] Foreign Application Priority Data

Aug. 18, 1995 [IL] Israel ..... 114997

[51] Int. Cl.[6] ..... A63B 21/02

[52] U.S. Cl. ..... 482/146; 482/130; 482/123

[58] Field of Search ..... 482/146, 121, 482/123, 129, 79, 130

[56] References Cited

U.S. PATENT DOCUMENTS

| | | | |
|---|---|---|---|
| 735,319 | 8/1903 | Urwick | 482/146 |
| 2,906,532 | 9/1959 | Echols | 482/146 |
| 3,511,500 | 5/1970 | Dunn | 482/146 |
| 4,509,743 | 4/1985 | Lie . | |
| 4,653,748 | 3/1987 | Seel et al. . | |
| 4,822,039 | 4/1989 | Gonzales et al. | 482/146 |
| 5,582,567 | 12/1996 | Chang | 482/146 |

FOREIGN PATENT DOCUMENTS

| | | | |
|---|---|---|---|
| 940953 | 1/1974 | Canada | 482/146 |

OTHER PUBLICATIONS

Abstract of European Patent No. 0 088 643, Published Sep. 14, 1983, "Balance Training Apparatus".

Israel Patent No. 104113, Dec. 16, 1992, Drawings and Claims, "Multi–Position Foot Rest".

Abstract of French Patent No. 2,364,044, Sep. 9, 1976.

Abstract of German Patent Publication No. 224,374, Mar. 14, 1974.

Abstract of German Patent Publication No. 1,578,552, Apr. 15, 1971.

*Primary Examiner*—Lynne A. Reichard

*Attorney, Agent, or Firm*—Steinberg, Raskin & Davidson, P.C.

[57] ABSTRACT

The invention provides an exercise device for independently exercising both the thigh and calf muscles of at least one leg of a user, including a base provided with a pair of spaced-apart, upwardly-extending sides, a plate-like member having a top surface, a bottom surface, a front end, a back end and two sides, at least one pivot element pivotally interconnecting the plate-like member and the upwardly-extending sides with a major axis of the plate-like member perpendicular to the axis of the pivot element, the at least one pivot element supporting the plate-like member in proximity to the mid-point of the major axis, and at least two energy-absorbing elements respectively attaching the front end and the back end of the plate- like member to adjacent surfaces of the base, the arrangement being such that the plate-like member can be pivotally oscillated relative to the base when a moment is applied thereto against the resistance of at least one of the energy-absorbing elements.

10 Claims, 4 Drawing Sheets

FIG.1
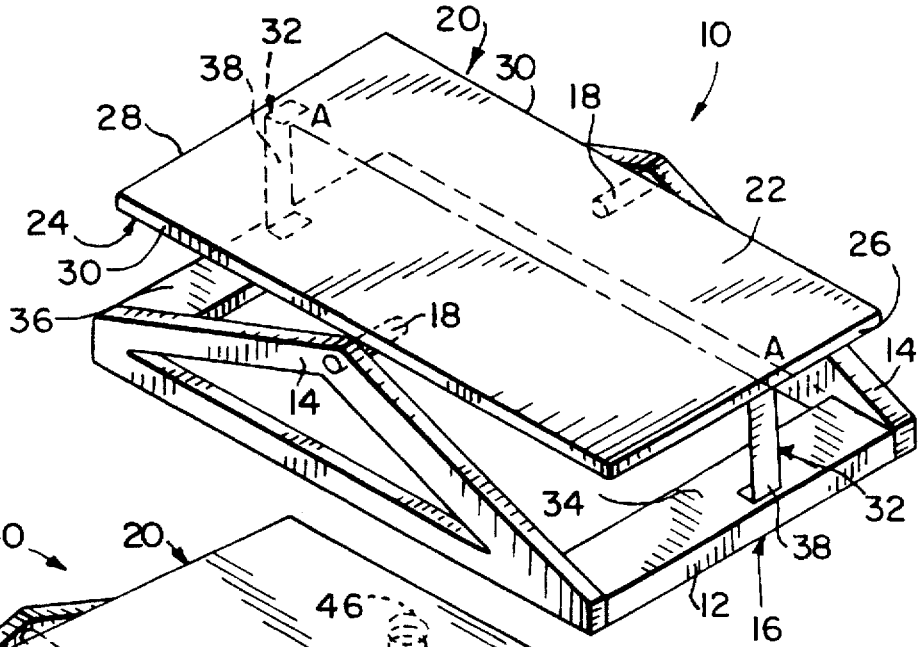
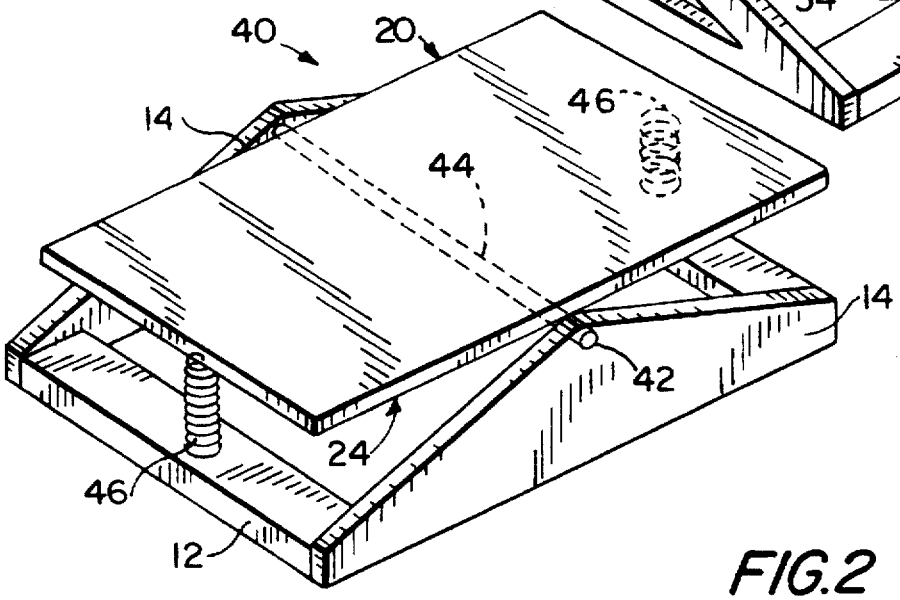
FIG.2

EXERCISING DEVICE

The present invention relates to a leg exercising device. More particularly, the invention provides means to exercise both the thigh and calf muscles of a user, the unobtrusive appearance of the device making it suitable for office, as well as home, use.

Today there is widespread acceptance of the need to exercise the body so as to maintain good health, as is evidenced by the popularity of activities such as jogging, swimming and bicycling. For those who prefer to remain indoors, there is available a wide variety of treadmills, stairclimbers, stationary bicycles, rowers, weight lifters, toning tables, combination exercise sets, etc. Some of this equipment is large and expensive and is best suited for installation in fitness clubs and exercise rooms. For home use, smaller and less expensive equipment is required.

Due to their distracting nature and appearance, known types of exercise equipment are not used in the workplace. However, many workers are deskbound; with the widespread use of computers, more and more people spend their workdays sitting at a keyboard.

Bearing in mind the above-described state of the art, it is one of the objects of the present invention to provide a leg exercising device which can be used at the workplace or in the home.

The present invention achieves said objective by providing an exercise device for independently exercising both the thigh and calf muscles of at least one leg of a user, comprising a base provided with a pair of spaced-apart, upwardly extending sides; a plate-like member having a top surface, a bottom surface, a front end, a back end and two sides; at least one pivot element pivotally interconnecting said plate-like member and said upwardly extending sides with a major axis of said plate-like member perpendicular to the axis of said pivot element, said at least one pivot element supporting said plate-like member in proximity to the mid-point of said major axis; at least two energy-absorbing elements respectively attaching said front end and said back end of said plate-like member to adjacent surfaces of said base; the arrangement being such that said plate-like member can be pivotally oscillated relative to said base when a moment is applied thereto against the resistance of at least one of said energy-absorbing elements.

The device of the present invention can be unobtrusively positioned under an office desk, and the person working there can utilize free moments to exercise without leaving his chair.

In contradistinction to known treadmills and stairclimber exercisers, during use the device of the present invention changes the angle of the user's foot back and forth: in a down stroke, the heel is raised and pressure is applied by the toes, while during the return stroke, the toes are freed and pressure is applied by the heel.

In a preferred embodiment of the present invention, there is provided an exercise device wherein a pair of side-by-side plate members is pivotally attached to said connecting member, each plate member being oscillatable independently and each plate member being connected to at least two independent energy-absorbing elements, the space between the major axes of the plate-like members being at least equal to the width of the user's foot.

Exercise equipment is less bulky and therefore easier to transport, and less costly to manufacture, when it is sold unassembled. For those willing to self-assemble the device of the present invention, there is provided a home assembly exercise device kit, comprising the components listed above in disassembled form, and further including assembly instructions and packaging.

The invention will now be described in connection with certain preferred embodiments and with reference to the following illustrative figures, so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a perspective view of a preferred embodiment of the leg exerciser according to the invention;

FIG. 2 is a perspective view of a second embodiment of the device of the invention;

Figure 3:
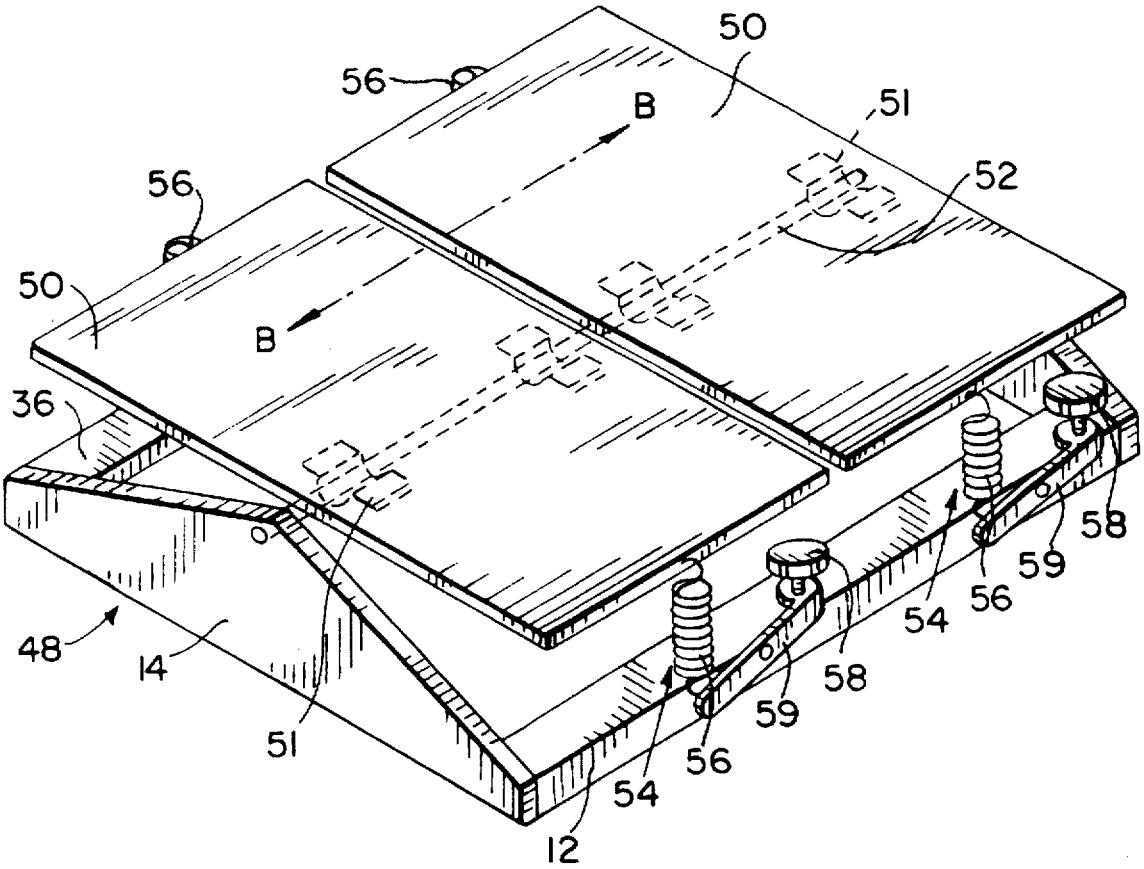
FIG. 3 is a perspective view of a particularly preferred embodiment having two footboards.

Referring now to the drawings, there is seen in FIG. 1 an exercise device 10 for independently exercising both the thigh and calf muscles of the leg of a user. A base 12 is provided with a pair of spaced-apart, upwardly extending sides 14. The lower face 16 of base 12 is sufficiently large to prevent damage to flooring materials when device 10 is in use. Base 12 and sides 14 can suitably be made of a foamed thermoplastic such as structural foam polypropylene, polyethylene, or PVC.

Two short pivot members 18 project coaxially toward each other, one from each of the upwardly extending sides 14. A plate-like member 20 has a top surface 22, a bottom surface 24, a front end 26, a back end 28 and two sides 30. The plate-like member 20 is pivotally connected to both pivot members 18 and has a major axis AA extending substantially perpendicular thereto. The pivot members 18 support plate-like member 20 in proximity to the mid-point of axis AA.

Two energy-absorbing elements 32 respectively attach front end 26 and back end 28 to adjacent surfaces 34, 36 of base member 12. The arrangment is such that plate-like member 20 can be pivotally oscillated relative to base member 12 when a moment is applied thereto by the user's foot against the resistance of one of the energy-absorbing elements 32. In the embodiment shown in FIG. 1, the elements 32 comprise elastomeric straps 38, which act as tensioning elements.

Referring now to FIG. 2, similar reference numerals are used for identifying similar parts.

There is seen in FIG. 2 an exercise device 40, generally similar to device 10. Pivot member 42 is a single, elevated, rod-like connecting member extending between the upwardly extending side members 14. Upper surface 44 of member 42 is attached to the bottom surface 24 of plate-like member 20. Member 42 pivots within side members 14. In this embodiment, the energy-absorbing elements comprise partially open steel coil compression springs 46, for improved durability.

FIG. 3 illustrates a device 48, which allows independent exercise of both legs of the user. A pair of side-by-side plate-like members 50 are pivotally attached by brackets 51 as shown, or simply resting in a groove underneath each member 50 (not shown), to a round-section pivot member 52. Each plate-like member 5 is independently oscillatable and each is connected to two in dependent energy-absorbing elements 54. Space BB between the major axes CC of the plate-like members 50 is a t least equal to the width of the user's foot, i.e., at least 11 cm. The energy-absorbing elements 54 of device 48 are steel tension springs 56. The spring tension is adjustable by the user, by means of a handscrew 58 and rocker arm 59, to provide the desirable degree of resistance.

Figure 4:
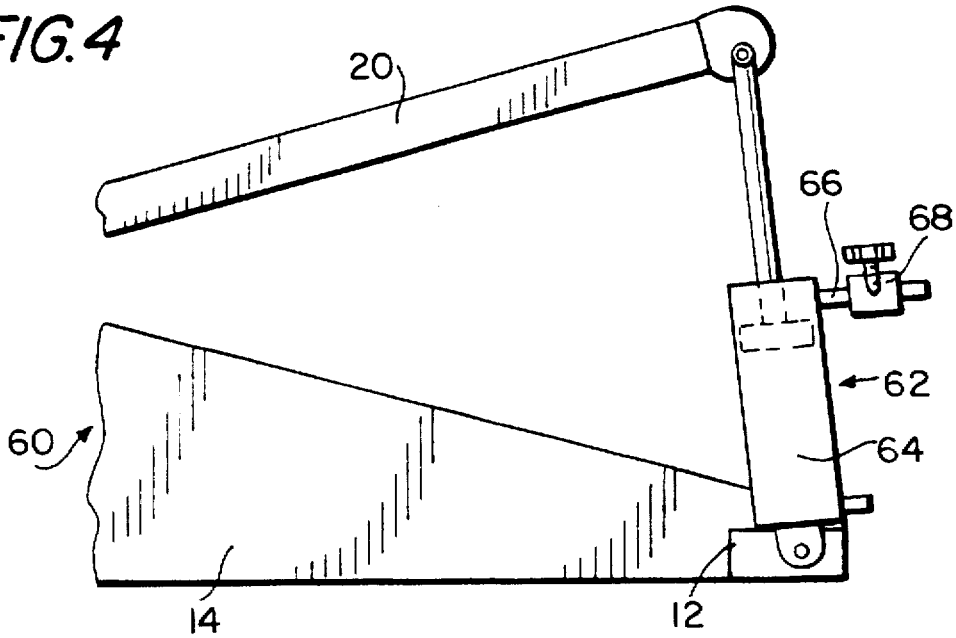
FIG. 4 is a detailed view of an embodiment having an air cylinder for energy absorption.

FIG. 4 details a further exercise device 60, wherein at least one of the energy-absorbing elements 62 comprises an air cylinder 64, provided with at least one restricted flow port 66. Air cylinder 64 provides increased resistance with increased speed of operation. An adjustable flow restrictor valve 68, fitted to the cylinder ports 66, provides convenient means for allowing the user to select a chosen degree of resistance.

Figure 5:
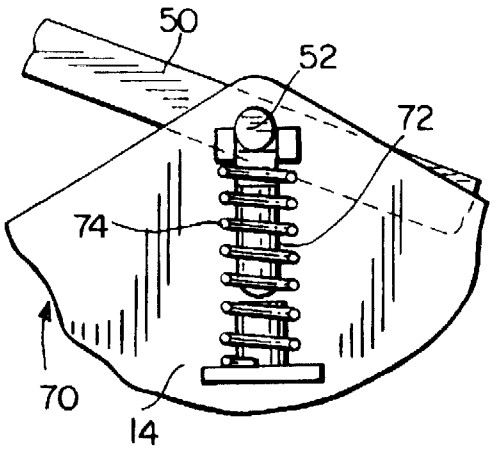
FIG. 5 is a detailed view of an embodiment having a floating height footboard.

With reference to FIG. 5, there is shown a detail of an embodiment 70, similar to device 48 shown in FIG. 3, but providing additional motion in the vertical plane. Pivot member 52 rides in a pair of vertically oriented slots 72. Springs 74 urge pivot member 52 to take up its highest possible position. When the user applies sufficient foot pressure, the pivot member 52 rides down slot 72, against the resistance of the spring 74.

Figure 6:
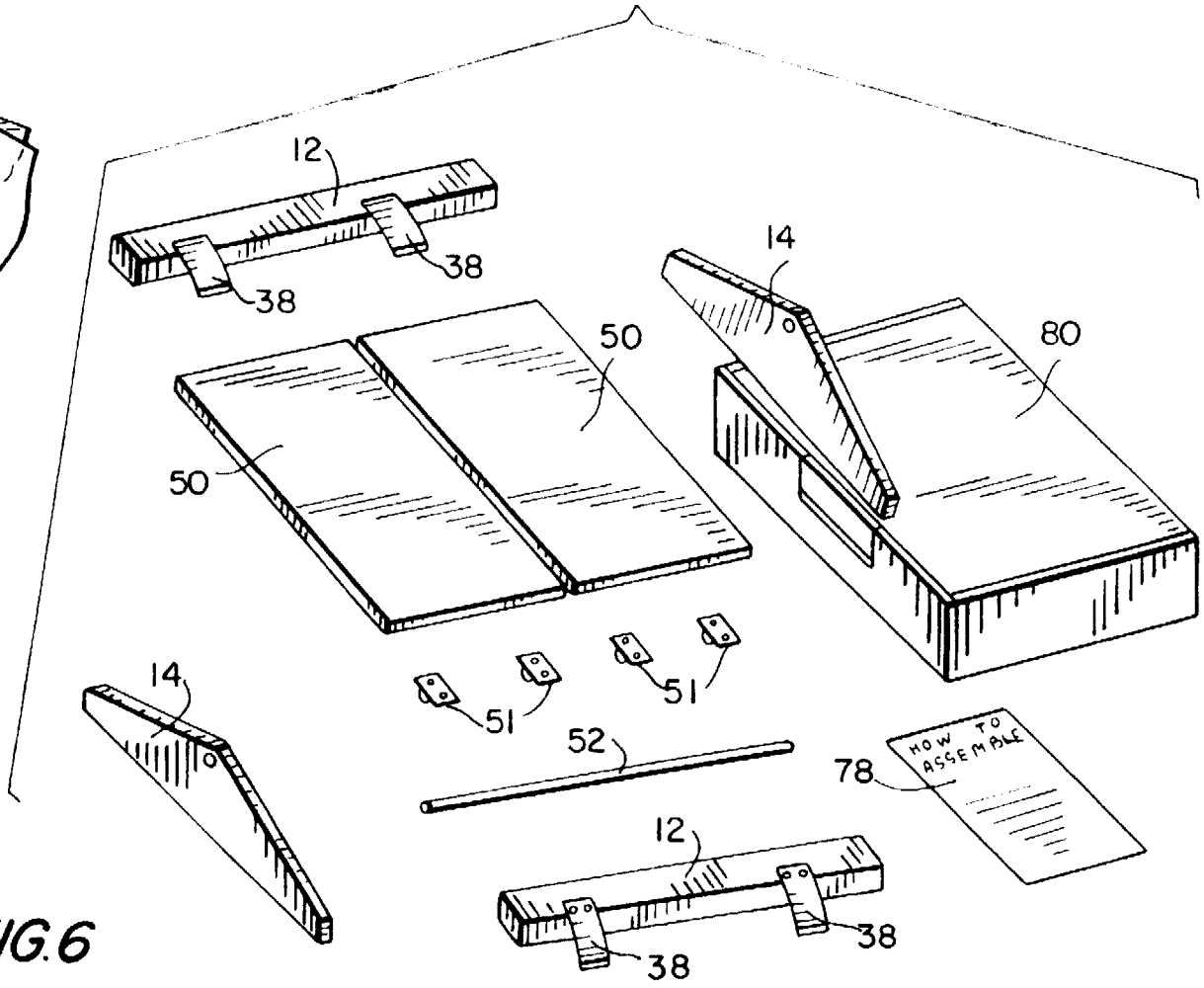
FIG. 6 is a perspective view of an exerciser provided in kit form for self assembly.

Seen in FIG. 6 is an exercise device kit 76 for self assembly by the user. Included in the kit are all the components of the device in disassembled form. Assembly instructions 78 are given on a printed sheet, and the kit is packaged in a printed carton 80.

Figure 7:
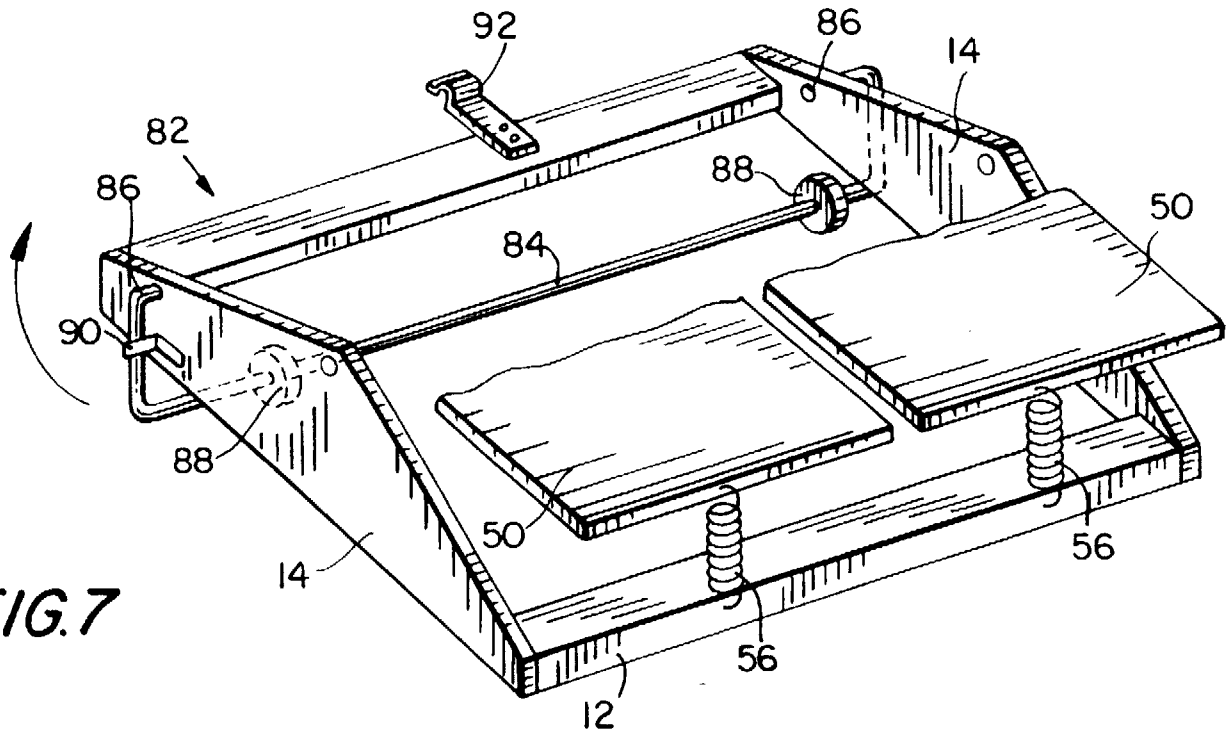
FIG. 7 is a fragmented, perspective view of an embodiment having a pivoted rear leg.

FIG. 7 depicts a detail of an exercise device 82 wherein the base member 14 is further provided with a pivoted leg 84. When deployed, the leg 84 raises the rear of the device, thus causing leg and thigh muscles to be exercised which are different from those which are exercised when leg 84 is not in use. Leg 84 as shown is made of a bent steel rod, the extremities thereof serving as pivots 86; advantageously, a pair of rubber rings 88 around the rod contact the floor. When deployed, leg 84 contacts stop 90, and it is retained by clip 92 when not in use.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An exercise device for independently exercising both the thigh and calf muscles of at least one leg of a user; comprising:

a base provided with a pair of spaced-apart, upwardly-extending sides;

a plate member having a top surface, a bottom surface, a front end, a back end and two sides;

at least one pivot element pivotally interconnecting said plate member and said upwardly-extending sides with a major axis of said plate member perpendicular to the axis of said at least one pivot element, said at least one pivot element supporting said plate member in proximity to the midpoint of said major axis;

at least first and second energy-absorbing elements respectively attaching said front end and said back end of said plate member to adjacent surfaces of said base, each of said first and second energy-absorbing elements comprising an elastomeric strap;

the arrangement being such that said plate member is pivotally oscillatable relative to said base when a moment is applied thereto against the resistance of at least one of said energy-absorbing elements.

2. The exercise device as claimed in claim 1, wherein said at least one pivot element is a single, elevated, rod connecting member extending between said upwardly extending sides, an upper surface of said connecting member being attached to said bottom surface of said plate member.

3. An exercise device kit for self assembly, comprising the components according to claim 1 provided in disassembled form, and further including assembly instructions and packaging.

4. The exercise device as claimed in claim 1, wherein said at least one pivot element comprises first and second pivot elements, said first and second pivot elements extending inward from a respective one of said upwardly-extending sides toward one another.

5. An exercise device comprising:

a base;

a member with which an appendage of a user of the exercise device to be exercised engages, support means for supporting said member said support means extending upwardly from said base and defining two spaced locations, said member extending at least in part between said two spaced locations;

at least one pivot element pivotally interconnecting said member and said support means such that said member is pivotally oscillatable relative to said base; and at least two energy absorbing elements engageable with said member on opposing sides of said at least one pivot element, each of said energy-absorbing elements comprising an elastomeric strap.

6. The exercise device as claimed in claim 5, wherein said at least one pivot element is a single rod extending between said two spaced locations, said rod being attached to said member.

7. The exercise device as claimed in claim 5, wherein said support means comprise first and second sides spaced from one another.

8. The exercise device as claimed in claim 7, wherein said at least one pivot element comprises first and second pivot elements, said first and second pivot elements extending inward from a respective one of said first and second sides toward one another.

9. The exercise device as claimed in claim 5, wherein said member is substantially planar.

10. The exercise device as claimed in claim 5, wherein each of said energy absorbing elements is coupled to said base, said energy absorbing elements extending between said base and said member.

* * * * *